United States Patent [19]

Martinelli et al.

[11] 3,971,514

[45] July 27, 1976

[54] MEAT GRINDER ATTACHMENT

[76] Inventors: Luigi E. Martinelli, 5164 Rafton Drive, San Jose, Calif. 95124; George S. Cerelli, 4161 Keith Drive, Campbell, Calif. 95008

[22] Filed: June 16, 1975

[21] Appl. No.: 587,125

[52] U.S. Cl. ..... 241/82.4; 241/82.5; 241/163

[51] Int. Cl.[2] ..... B02C 18/30

[58] Field of Search ..... 241/82.1, 82.2, 82.4, 241/82.5, 82.6, 162, 163

[56] References Cited

UNITED STATES PATENTS

| | | | |
|---|---|---|---|
| 1,435,796 | 11/1922 | Bennett | 241/82.4 |
| 2,050,758 | 8/1936 | Long | 241/82.4 |
| 2,633,170 | 3/1953 | Balmain | 241/82.4 |
| 3,323,570 | 6/1967 | Tullock et al. | 241/82.4 |

*Primary Examiner*—Granville Y. Custer, Jr.
*Attorney, Agent, or Firm*—Phillips, Moore, Weissenberger, Lempio & Strabala

[57] ABSTRACT

The invention is concerned with an improved grinder useful for grinding meat, which grinder includes a first section for coarsely grinding the meat followed by a second section for more finely grinding the meat, the two sections including screws which are coaxial with each other and driven by a common power source. The improvement comprises a cylindrical section intermediate the coarse grinding section and the fine section, the intermediate section including a shaft coaxial with both of the screws and connecting one screw to the other with a chamber surrounding said shaft. The shaft includes two partial screw threads both of which have pitches greater than the pitches of the threads in the two grinding sections. The intermediate section serves to transfer meat or the like from the coarse grinding section to the fine grinding section at a rate such that the fine grinding section can effectively grind the meat into a fine grind while not becoming clogged and not tending to overload the common power supply for the overall grinding apparatus.

10 Claims, 11 Drawing Figures

MEAT GRINDER ATTACHMENT

BACKGROUND OF THE INVENTION

1. Field of the Invention

The invention is concerned with the grinding art and more particularly with an improvement in a grinder which includes first a coarse grinding section and then a fine grinding section, the powered screws which operate in both of the sections being coaxial and driven by a common power supply. Such grinders find application in the conversion of chunks of meat into ground meat and the like.

2. Prior Art

The prior art discloses any number of apparatuses for feeding meat and other materials into a hopper and thence to a first section wherein the meat is ground coarsely by being forced passed a knife and through holes in a first plate and then is immediately passed into a second grinding section wherein the coarsely ground meat is then forced passed a second knife and through smaller holes in another plate whereby the finally exiting meat has been converted into ground meat of a desired texture. It is clearly advantageous to provide a machine which, by operating on a single power supply, will allow a complete conversion of unground meat to ground meat of a desired size.

In general, however, such devices as described above and as may be found described in more detail in any of U.S. Pat. Nos. 800,452; 865,095; 1,115,243; 1,435,796; 2,500,758 and 2,229,845 have not found wide acceptance in the meat handling industry. An important reason for the general lack of acceptance of such machinery has been that the apparatus of the prior art has tended to require the use of a relatively large motor to drive the screws in the coarse grinding and fine grinding sections thereof becasue of the build up of back pressure within the apparatus. Thus, overheating of small motors would tend to occur along with relatively slow evolution of the finally finished product. Also, there has been a great tendency for the meat to overheat during such double grinding operations thus increasing chances for undesirable bacterial growth therein. Accordingly, it has been the customary practice in the meat handling industry to use two separately powered units for converting chunks of meat to ground meat. In the first unit, the chunks of meat are customarily forced through a plate with relatively large holes (a "chili" plate) and coverted into a ropy material having too coarse a grind to be readily suitable for sale and later human consumption. This coarse material has then been transported generally to a second machine driven by a separate motor wherein it is set in a hopper and then forced through the second machine and passed a knife and a plate having smaller holes wherein it is converted to a material suitable for sale. Alternately, a single machine can be used with a chili plate being used for the first passage therethrough and a fine grind (small hole) plate for the second passage therethrough. Simple machines which utilize only a single plate having relatively small holes are also known to the prior art. These machines tend to operate relatively slowly and to require relatively large motors to force the chunks of material which are initially set into the machine passed the knife and through the relatively small holes at the outlet of the machine. Hence, such simple machines are not practical in commercial applications.

An apparatus which would operate from a single power source and wherein chunks of meat could be fed into this apparatus and therein converted in a first section to a coarse ground product and then in a second section to a fine ground product suitably for sale yet wherein an overly large motor was not required and wherein relatively high throughput rates and low temperature rise for the meat could be maintained would clearly solve the above mentioned problems of the prior art grinding apparatus. The present invention provides an apparatus which solves the above mentioned prior art problems as will become apparent from the description which follows and the accompanying drawings.

SUMMARY OF THE INVENTION

The invention comprises an improvement in a grinder which includes a feed hopper for delivering material to be ground to a first cylindrical chamber, a first screw having a first pitch within said first chamber for coarsely grinding and transporting said material from said hopper passed a first rotary knife mounted to said first screw and through a first plurality of generally equally sized holes in a first plate, a second screw having a second pitch drivingly attached coaxially to said first screw within a second cylindrical chamber for finely grinding and transporting said material from said first plate passed a second rotary knife mounted to said second screw and through a second plurality of generally equally sized holes in a second plate, the holes of said first plurality of holes being larger than the holes of said second plurality of holes and means for driving said first screw and thereby also said second screw. The improvement of the invention comprises a shaft coaxial with and connecting together the first and second screws and having a third cylindrical chamber surrounding it and connecting the first and second cylindrical chambers. Extending radially from the shaft within the third chamber commencing adjacent the first plate and terminating adjacent a central portion of the third chamber is a first partial screw thread having a third pitch which is greater than said first pitch and greater than said second pitch. A second partial screw thread which is non-contiguous with said first partial screw thread and which has a fourth pitch greater than said first pitch and greater than said second pitch, extends radially from the shaft within the third chamber commencing adjacent the central portion of the third chamber and terminating adjacent the second screw.

BRIEF DESCRIPTION OF THE DRAWINGS

The invention will be better understood by reference to the drawings in the figures of which like numbers deonte like parts throughout and wherein.

DETAILED DESCRIPTION OF THE PREFERRED EMBODIMENT

Figure 1:
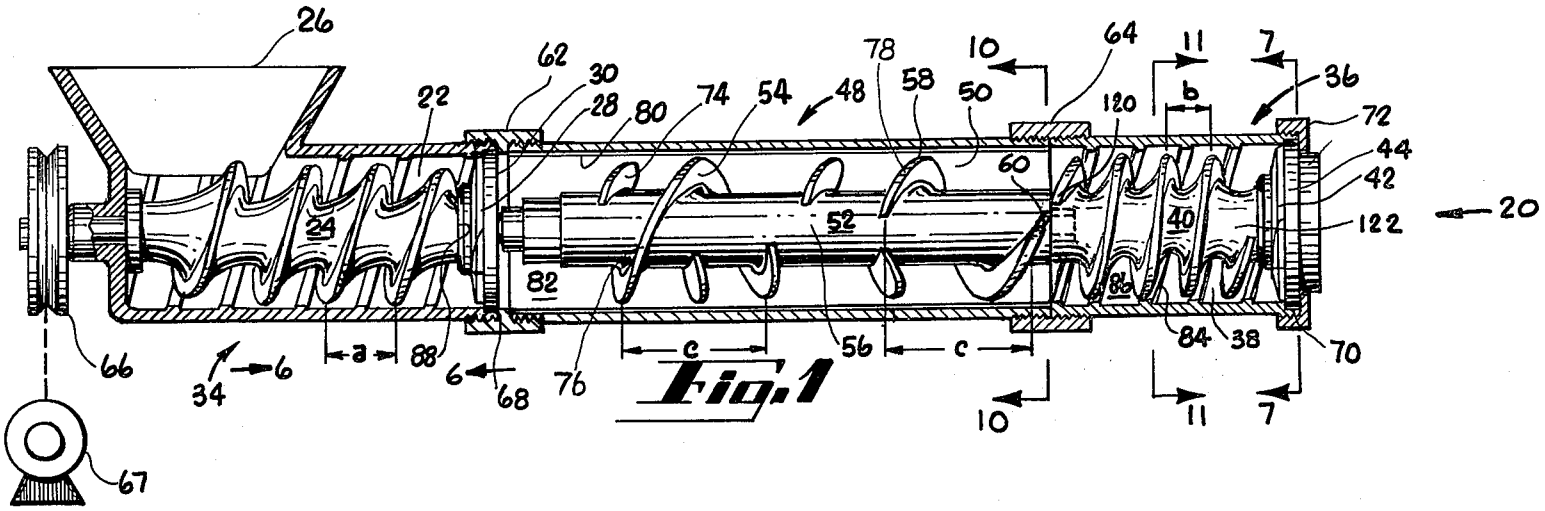
FIG. 1 is a side elevational partially sectioned view illustrating a grinder including the improvement of the present invention.

FIG. 1 illustrates an improved meat grinder 20 constructed in accordance with the present invention. The meat grinder 20 includes a first cylindrical chamber 22 having a first screw 24 therewithin. The first screw 24 is adapted to receive material such as meat or the like from a hopper 26 and then to transport the material along the first cylindrical chamber 22 passed a first knife 28 and then passed a first (chili) plate 30 having a first plurality of holes 32 passing therethrough from one face thereof and to the other and having a first notch 31 therein. The first screw 24 has a first pitch *a* as illustrated. The first cylindrical chamber 22 along with the first screw 24, the first knife 28 and the first plate 30 forms a first section 34 of the grinder 20.

A second section 36 is illustrated in the right-hand portion of FIG. 1. The second section 36 comprises a second cylindrical chamber 38 with a second screw 40 therewithin. The second screw 40 has a second pitch *b* generally somewhat smaller than the pitch *a* as illustrated. Also a part of the second section 36 is a second knife 42 generally identical to the first knife 28 and a second plate 44 having a second plurality of holes 46 passing therethrough from one face thereof to the other and having a second notch 47 therein. The holes of the second plurality of holes 46 are smaller than the holes of the first plurality of holes 32. In this manner, meat is first coarsely ground by passage through the first plurality of holes 32 under the impetus of the first screw 24 and with cutting by the first knife 28 and then the partial ground material is further ground to a smaller and usable size through passage through the second plurality of holes 46 under the impetus of the second screw 40 and with cutting by the second knife 42.

Intermediate the first section 34 and the second section 36 there is provided a third section 48. The third section 48 comprises a third cylindrical chamber 50 surrounding a shaft 52. The shaft 52 is coaxial with and connects together the first screw 24 and the second screw 40. The third cylindrical chamber 50 serves to connect together the first cylindrical chamber 22 and the second cylindrical chamber 38. Extending radially from the shaft 52 within the third cylindrical chamber 50 is a first partial screw thread 54. The first partial screw thread 54 commences adjacent the first plate 30 and terminates adjacent a central portion 56 of the shaft 52. A second partial screw thread 58 which is non-contiguous with said first partial thread 54 extends radially from the shaft 52 within the third cylindrical chamber 50 commencing adjacent the central portion 56 of the shaft 52. The second partial screw thread 58 terminates adjacent the second screw 40. The first partial screw thread 54 has a third pitch *c* which is greater than the first pitch *a* and greater than the second pitch *b*. Similarly, the second partial screw thread 58 has a pitch generally equal to the third pitch *c* but which in any event is greater than the first pitch *a* and greater than the second pitch *b*.

As illustrated in FIG. 1, the second partial screw thread 58 is so aligned relative to the second screw 40 whereby said second partial screw thread 58 feeds material directly to said second screw 40. This is accomplished, as illustrated, by the approximate mating of an end 60 of the second partial screw thread 58 proximal the second screw 40 with the threads of said second screw 40. The first section 34 is generally screw fastened to the second section 36 as for example by utilizing an internally theaded screw fitting 62. Similarly, the second section 36 is attached to the third section 48 by use of another screw fitting 64 which is also internally threaded. Power is supplied to the first screw 24 and therefrom to the shaft 52 and therefrom to the second screw 40 by a belt which passes around the pulley 66 and proceeds thence to for example an electric motor 67 or the like. Alternately, power can be supplied to the first screw 24 by directly or gearingly connecting it to the motor 67. The first cylindrical chamber 22 has a cavity 68 cut therein with a first nub 69 extending into said cavity 68 so that the first plate 30 can be firmly held thereagainst by the screw fitting 62 and the first notch 31. The second plate 44 fits within a cavity 70 similarly undercut into the second cylindrical chamber 38 with a second nub 71 extending therein. The second plate 44 is then held in place by a collar 72 and the fitting of the second nub 71 within the second notch 47.

Extending radially from the shaft 52 are means for mixing material as it passes through the third cylindrical chamber 50. The preferred means comprise a plurality of paddles 74 useful for mixing the material as stated above and also useful for advancing the material towards the second section 36. The usefulnesss in advancing the material towards the second section 36 is enhanced by angling the paddles 74 generally parallel to the first partial screw thread 54 for those paddles thereadjacent and to the second partial screw thread 58 for those paddles thereadjacent.

Figure 10:
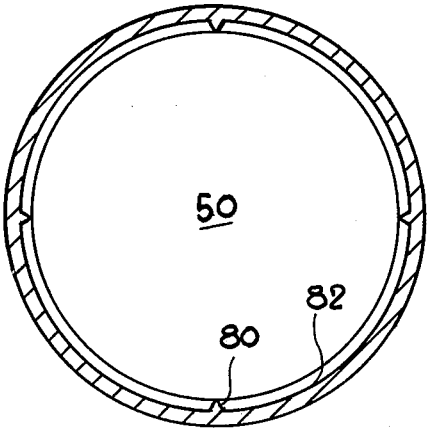
FIG. 10 illustrates a view taken along the plane 10—10 of FIG. 1.

As will be noted by reference to FIG. 1, an outer edge 76 of the first partial screw thread 54 and an outer edge 78 of the second partial screw thread 58 are each separated from the bore of the third cylindrical chamber 50 by a finite distance. Generally such distance is at least equal to one-half the average diameter of the holes of the first plurality of holes 32 of the first plate 30. It has been found generally desirable to provide a plurality of generally equally spaced ridges 80 as illustrated in FIGS. 1 and 10, longitudinally upraised from an inner wall 82 of the third chamber 48. The plurality of ridges 80 generally run the length of the third cylindrical chamber 50. The ridges 80 tend to provide sufficient clearance about the first partial screw thread 54 and the second partial screw thread 58 so that coarsely ground meat can be propelled through the third section 48 without the development of back pressure through clogging in the grinder 20.

Figure 11:
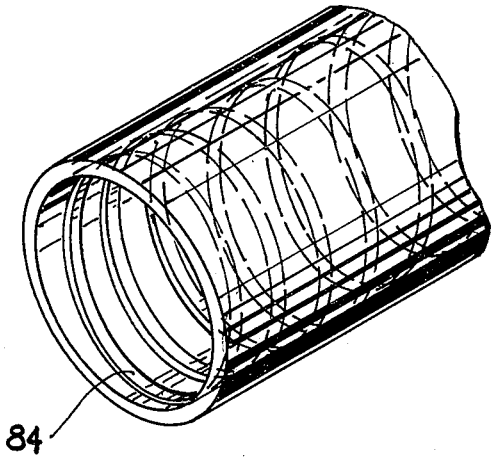
FIG. 11 illustrates in perspective a view of the fine grinding section of a grinder in accordance with the present invention taken generally from the plane 11—11 of FIG. 1.

As illustrated most clearly in FIGS. 1 and 11, the second cylindrical chamber 38 includes a plurality of helical ridges 84 upraised from an inner wall 86 thereof, said helical ridges 84 being aligned to increase meat throughput rate by channeling material towards said second plate 44.

Figure 5:
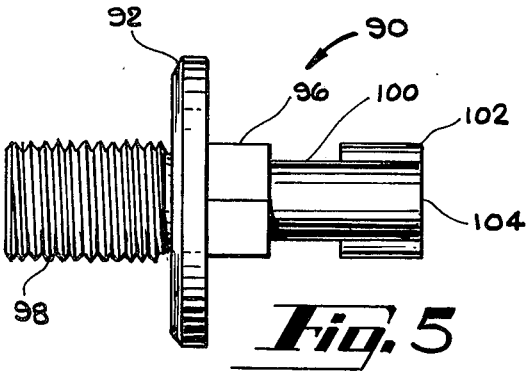
FIG. 5 illustrates in side elevation a member adapted to drivingly couple a first screw within a first chamber to the shaft illustrated in FIG. 2.
Figure 6:
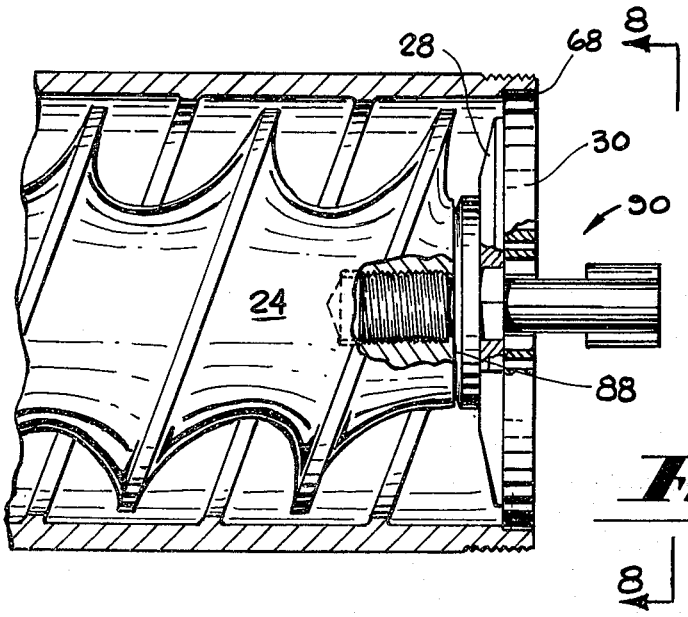
FIG. 6 illustrates a detail in the area 6—6 of FIG. 1.
Figure 7:
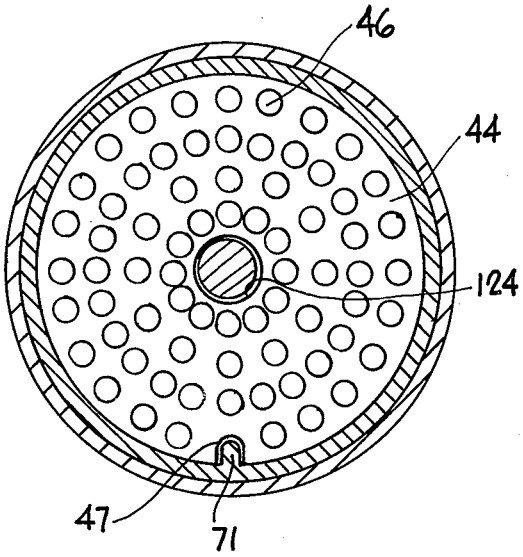
FIG. 7 illustrates a view taken from the plane 7—7 of FIG. 1.
Figure 8:
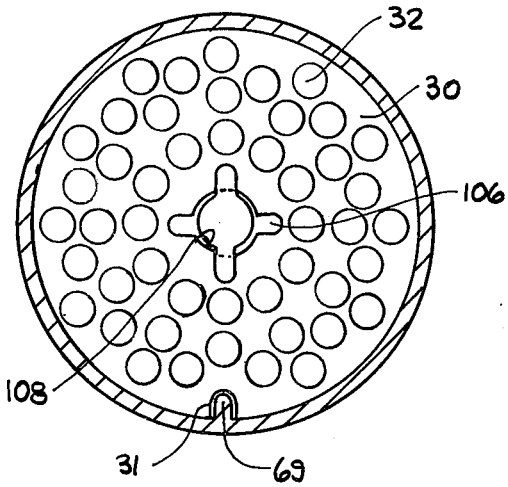
FIG. 8 illustrates a view taken from the plane 8—8 of FIG. 6.

Reference to FIGS. 4, 5, 6, 8 and 9 will best illustrate the means provided for drivingly attaching the first screw 24 to the shaft 52 while at the same time fixing the first plate 30 and the first knife 28 in place. The first screw 24 has a threaded hole therein adjacent an end 88 thereof proximal the shaft 52. A driving adaptor 90 illustrated most clearly in FIG. 5 is screw threaded into the tapped hole at said end 88 of the first screw 24. This serves to abut the flange 92 against the end 88 of the first screw 24. The first knife 28, which has a generally square opening 94 centrally thereof in the usual manner then fits up over a square member 96 which proceeds from the flange 92 on a direction thereof opposite a threaded portion 98 thereof. Proceeding from the square member 96 away from the flange 92 is a rod 100. A pair of ears 102 extend outwardly from a far end 104 of the rod 100. In use, the threaded portion 98 is screwed into the hole in the end 88 of the first screw 24, the first knife 28 is placed over the square member 26 and the first plate 30 is passed over the rod 100 by aligning the first plate 30 so that a pair of indentations 106 in a central opening 108 in the first plate 30 are aligned with the pair of ears 102 which extend from the far end 104 of the rod 100. The screw fitting 62 is then put in place. FIG. 6 illustrates the structure obtained by these operations.

Figure 2:
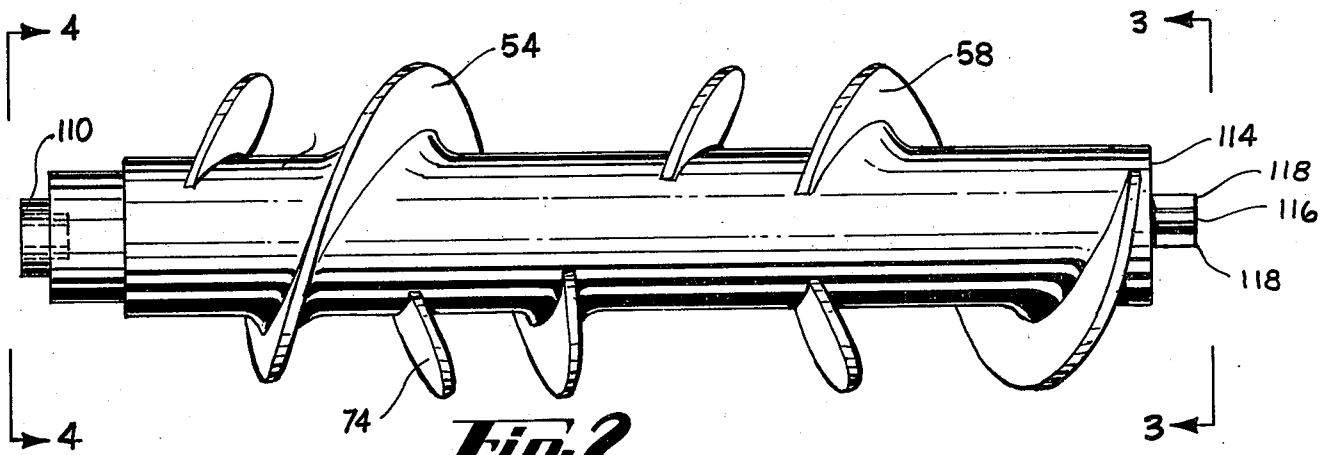
FIG. 2 illustrates in side elevation the threaded shaft of the improvement of the present invention.
Figure 3:
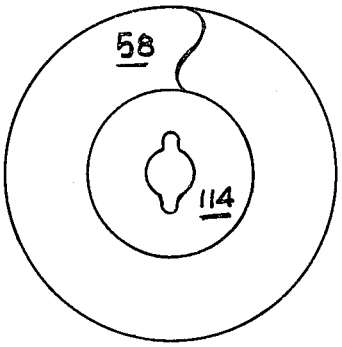
FIG. 3 illustrates a view taken from the plane 3—3 of FIG. 2.
Figure 4:
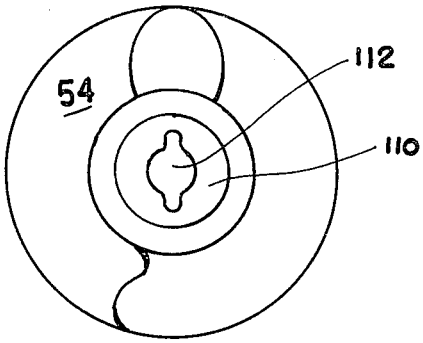
FIG. 4 illustrates a view taken from the plane 4—4 of FIG. 2.
Figure 9:
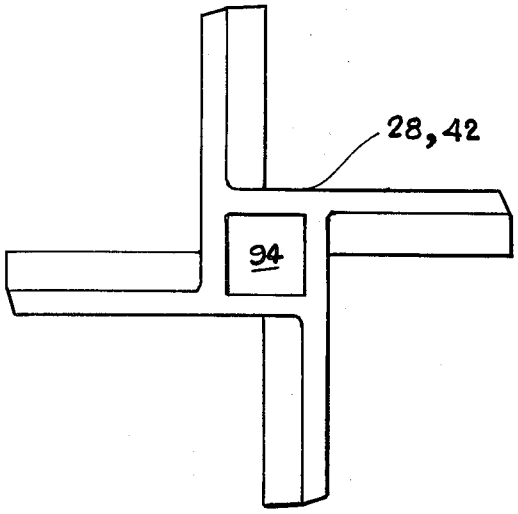
FIG. 9 illustrates a knife blade useful in the grinder of the present invention.

A first end 110 of the shaft 52 which is illustrated most clearly in FIGS. 2 and 4 and which includes a cavity 112 therein, is then placed in generally mating relation over the far end 104 of the driving adaptor 90 whereby said far end 104 and the pair of ears 102 thereon are matingly received within the cavity 112. Thus, a driving relationship is created between the first screw 24 and the shaft 52. The screw fitting 62 is then used to fasten the first section 34 to the third section 48. The second end 114 of the shaft 52 has a bar 116 with a pair of ears 118 extending therefrom thereby forming substantially an identical structure to that formed by the far end 104 of the rod 100. The bar 116 with its extending pair of ears 118 are fitted within a cavity within a first end 120 of the second screw 40. The cavity within the first end 120 of the second screw 40 is substantially identical to the cavity 112 which is illustrated in FIG. 4. Thus, a driving relationship is assured between the shaft 52 and the second screw 40. The screw fitting 64 and the second cylindrical chamber 38 are then fastened in place, said screw fitting 64 serving to hold the second cylindrical chamber 38 in end to end abutting relationship with the third cylindrical chamber 50.

A second end 122 of the second screw 40 then has attached over a square member which extend therefrom and is identical to the square member 96, the second knife 42 followed by the second plate 44 which has a circular central opening 124 centrally therethrough and in which a short rod extending from the square member at the second end 122 of the second screw 40 fits.

For improved operation of the improved grinder of the present invention, it is preferred that the pitch of the second partial screw thread 58 and the pitch of the first partial screw thread 54 are each at least about twice the pitch of the first screw 24 and likewise are at least about twice the pitch of the second screw 40.

OPERATION

The operation of the improved grinder of the present invention is relatively straight-forward. The material to be ground which is generally meat or meat plus one or more fillers is fed into the hopper 26. The first screw 24 which is turned as for example by the pulley 66 and a motor 67 driving it, proceeds to propel the chunks of material rightwardly as illustrated in FIG. 1 towards and passed the first knife 28 and thence through the relatively large holes of the first plurality of holes 32 in the first plate 30. Generally, the meat exiting the first plurality of holes 32 will be in the form of relatively thick coarse ground wires. The wires of material exiting the first plurality of holes 32 are then picked up and propelled rightwardly by the plurality of paddles 74 to some extent and most particularly by the first partial screw thread 54. The paddles 74 serve primarily, however, to stir together the coarsely ground meat so as to form a continuous and uniform mass thereof. In this manner, globules of fat and/or added vegetable protein material can be intermixed with globules of meat. The plurality of ridges 80 help to guide the meat towards the second cylindrical chamber 38. As previously stated, the edges of the first partial screw thread 54 and of the second partial screw thread 58 are always removed a significant distance from the inner wall 82 of the third section 48. This allows a relatively fast transportation of meat by the first partial screw thread 54 to the second partial screw thread 58 and therefrom to the second cylindrical chamber 38. Thus, the movement through the third section 48 leads to the supply of a loose well-mixed mass of material to the second section 36 whereby no back pressure develops within the third cylindrical chamber 50 to overload the motor driving the entire apparatus and whereby the temperature of the meat stays relatively low. The coarsely ground meat proceeds from the second partial screw thread 58 and is introduced directly to the second screw 40 which propels it as aided by the helical ridge 84 towards the second knife 42 and the second plate 44. As the coarsely ground material passes through the second plate 44, it is constantly being chopped by the second knife 42 which is rotating relative to the second plate 44 in the same manner that the first knife 28 is rotating relative to the first plate 30.

While the invention has been described in connection with specific embodiments thereof, it will be understood that it is capable of further modification, and this application is intended to cover any variations, uses or adaptations of the invention following, in general, the principles of the invention and including such departures from the present dislcosure as come within known or customary practice in the art to which the invention pertains and as may be applied to the essential features hereinbefore set forth, and as fall within the scope of the invention and the limits of the appended claims.

That which is claimed is:

1. In a grinder comprising a feed hopper for delivering material to be ground to a first cylindrical chamber; a first screw having a first pitch within said first chamber for coarsely grinding and transporting said material from said hopper passed a first rotary knife mounted to said first screw and through a first plurality of generally equal sized holes in a first plate; a second screw having a second pitch drivingly attached coaxially to said first screw within a second cylindrical chamber for finely grinding and transporting said material from said first plate passed a second rotary knife mounted to said second screw and through a second plurality of generally equal sized holes in a second plate; the holes of said first plurality of holes being larger than the holes of said second plurality of holes; and means for driving said first screw and thereby also said second screw; an improvement which comprises:

a shaft coaxial with and connecting together said first and second screws;

a third cylindrical chamber surrounding said shaft and connecting said first and second chambers;

a first partial screw thread having a third pitch greater than said first pitch and greater than said second pitch, said first partial screw thread extending radially from said shaft within said third chamber commencing adjacent said first plate and terminating adjacent a central portion of said shaft; and a second partial screw thread non-contiguous with said first partial screw thread having a fourth pitch greater than said first pitch and greater than said second pitch, said second partial screw thread extending radially from said shaft within said third chamber commencing adjacent the central portion of said shaft and terminating adjacent said second screw.

2. An improved grinder as in claim 1, wherein said partial screw thread is aligned to feed material directly to said second screw.

3. An improved grinder as in claim 2, including:

means extending radially from said shaft for mixing material as it passes through said third cylindrical chamber.

4. An improved grinder as in claim 3, wherein an outer edge of said first partial screw thread and an outer edge of said second partial screw thread are each a distance at least equal to one-half an average diameter of the holes of said first plurality of holes from an inner wall of said third chamber.

5. An improved grinder as in claim 4, including a plurality of generally equally spaced longitudinal ridges upraised from said inner wall of said third chamber and running generally the length thereof.

6. An improved grinder as in claim 5, wherein said mixing means comprises a plurality of paddles.

7. An improved grinder as in claim 6, wherein said third pitch and said fourth pitch are at least about twice said first pitch and at least about twice said second pitch.

8. An improved grinder as in claim 7, wherein said third pitch is generally equal to said fourth pitch.

9. An improved grinder as in claim 8, wherein said second chamber includes a plurality of integral helical ridges upraised from an inner wall thereof and aligned to channel material towards said second plate.

10. In a grinder comprising a feed hopper for delivering material to be ground to a first cylindrical chamber; a first screw having a first pitch within said first chamber for coarsely grinding and transporting said material from said hopper passed a first rotary knife mounted to said first screw and through a first plurality of generally equal sized holes in a first plate; a second screw having a second pitch drivingly attached coaxially to said first screw within a second cylindrical chamber for finely grinding and transporting said material from said first plate passed a second rotary knife mounted to said second screw and through a second plurality of generally equal sized holes in a second plate; the holes of said first plurality of holes being larger than the holes of said second plurality of holes; and means for driving said first screw and thereby also said second screw; an improvement which comprises:

a shaft coaxial with and connecting together said first and second screws;

a third cylindrical chamber surrounding said shaft and connecting said first and second chambers; and non-continuous screw thread means having a third pitch greater than said first pitch and greater than said second pitch, said non-continuous screw thread means extending radially from said shaft within said third chamber commencing adjacent said first plate and terminating adjacent said second screw.

* * * * *